US010319336B2

(12) United States Patent
Oh

(10) Patent No.: US 10,319,336 B2
(45) Date of Patent: Jun. 11, 2019

(54) ELECTRONIC DEVICE AND CONTROL METHOD THEREOF

(71) Applicant: SAMSUNG ELECTRONICS CO., LTD., Suwon-si, Gyeonggi-do (KR)

(72) Inventor: Sung-bo Oh, Seoul (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/295,066

(22) Filed: Oct. 17, 2016

(65) Prior Publication Data

US 2017/0236489 A1 Aug. 17, 2017

Related U.S. Application Data

(60) Provisional application No. 62/295,615, filed on Feb. 16, 2016.

(30) Foreign Application Priority Data

May 26, 2016 (KR) ..... 10-2016-0065013

(51) Int. Cl.
*G09G 5/00* (2006.01)
*G09G 5/18* (2006.01)

(52) U.S. Cl.
CPC ..... *G09G 5/006* (2013.01); *G09G 5/18* (2013.01); *G09G 2320/08* (2013.01); *G09G 2370/12* (2013.01)

(58) Field of Classification Search
CPC ..... G09G 5/006; G09G 5/18; G09G 2320/08; G09G 2370/12
See application file for complete search history.

(56) References Cited

U.S. PATENT DOCUMENTS 6,262,763 B1 * 7/2001 Totsuka ..... H04N 5/9201 348/135
6,714,253 B2 * 3/2004 Kim ..... H04N 5/4401 348/554

(Continued)

FOREIGN PATENT DOCUMENTS

EP 2706744 3/2014
JP 2014-153548 8/2014

(Continued)

OTHER PUBLICATIONS

Search Report and Written Opinion dated Mar. 24, 2017 in counterpart International Patent Application No. PCT/KR2017/000280.

*Primary Examiner* — Brian P Yenke
(74) *Attorney, Agent, or Firm* — Nixon & Vanderhye, P.C.

(57) ABSTRACT

An electronic device is disclosed. The electronic device receiving content from an external device includes a memory configured to include a first HDMI version of Extended Display Identification Data (EDID) information, a second HDMI version of EDID information, the second HDMI version being an upgraded version of the first HDMI version and, at least one resolution information supportable in the electronic device other than the first HDMI version of EDID information, an external interface configured to communicate with the external device and a processor configured to cause the second HDMI version of EDID information to not be read by the external device, to cause the EDID information of the first HDMI version among the EDID information to be read by the external device, and to cause the at least one resolution information to be read by the external device.

9 Claims, 12 Drawing Sheets

(56) References Cited

U.S. PATENT DOCUMENTS 7,224,404 B2 * 5/2007 An ..... H04N 5/4401 345/204
8,069,276 B2 * 11/2011 Kang ..... G09G 5/006 345/1.1
8,248,350 B2 * 8/2012 Yoon ..... G09G 3/3688 345/211
8,255,580 B2 * 8/2012 Kang ..... G09G 5/006 345/1.1
8,284,312 B2 * 10/2012 Suzuki ..... H04N 5/775 348/569
8,325,278 B2 * 12/2012 Oku ..... G09G 5/005 348/441
8,479,253 B2 * 7/2013 Glen ..... G09G 5/006 348/552
8,615,156 B2 * 12/2013 Glen ..... H04N 5/44543 386/200
8,705,941 B2 * 4/2014 Pan ..... H04N 5/602 345/699
8,738,809 B2 * 5/2014 Shoji ..... G09G 5/006 710/3
8,743,286 B2 * 6/2014 Hasegawa ..... H04N 5/765 348/552
8,755,668 B2 * 6/2014 Uchida ..... H04N 5/775 348/556
8,866,971 B2 * 10/2014 Glen ..... G09G 5/006 348/571
8,917,294 B2 * 12/2014 Tsai ..... H04N 1/603 345/590
9,059,833 B2 6/2015 Wang
9,258,602 B2 * 2/2016 Kabuto ..... G09G 5/006
9,258,603 B2 * 2/2016 Stelliga ..... H04N 21/43635
9,305,516 B1 * 4/2016 Suzuki ..... H04N 21/4122
9,473,678 B2 * 10/2016 Glen ..... G09G 5/006
9,549,144 B2 * 1/2017 Thompson ..... H04N 5/268
9,779,687 B2 * 10/2017 Park ..... G09G 5/006
9,924,134 B2 * 3/2018 Glen ..... H04N 7/0127
2002/0162102 A1 * 10/2002 Ihara ..... H04N 1/00291 725/9
2004/0090556 A1 * 5/2004 Kamieniecki ..... H04N 7/0122 348/558
2005/0027993 A1 * 2/2005 Yanagisawa ..... G09G 5/006 713/189
2007/0147799 A1 * 6/2007 Takamori ..... H04N 5/775 386/200
2007/0280646 A1 * 12/2007 Seita ..... H04N 5/781 386/231
2008/0055318 A1 * 3/2008 Glen ..... G09G 3/20 345/501
2008/0126591 A1 * 5/2008 Kwon ..... H04N 5/775 710/15
2008/0205855 A1 * 8/2008 Takamori ..... H04N 5/44513 386/231
2008/0271073 A1 * 10/2008 Kim ..... H04N 5/4403 725/37
2008/0285951 A1 * 11/2008 Takahashi ..... G11B 27/10 386/338
2009/0058868 A1 * 3/2009 Kang ..... G09G 5/006 345/581
2009/0086089 A1 * 4/2009 Matsui ..... H04N 7/015 348/441
2009/0207308 A1 * 8/2009 Shoji ..... G09G 5/006 348/554
2009/0307734 A1 * 12/2009 Doi ..... G09G 5/006 725/105
2010/0214480 A1 * 8/2010 Kitamori ..... H04N 5/775 348/554
2011/0090400 A1 * 4/2011 Huang ..... H04N 21/43635 348/554
2011/0289113 A1 * 11/2011 Arling ..... G08C 17/02 707/769
2011/0292295 A1 * 12/2011 Kawai ..... H04B 3/143 348/723
2012/0038655 A1 * 2/2012 Kang ..... G09G 5/006 345/530
2012/0166702 A1 * 6/2012 Toba ..... G06F 13/4068 710/316
2013/0169652 A1 7/2013 Choi et al.
2013/0230296 A1 * 9/2013 Yun ..... G06F 21/606 386/230
2014/0211941 A1 7/2014 Oh
2014/0282706 A1 * 9/2014 Kim ..... H04L 65/4084 725/33
2015/0015667 A1 * 1/2015 Laird ..... G06F 3/14 348/43
2015/0074232 A1 3/2015 Phillips et al.
2015/0160800 A1 * 6/2015 Kuwahara ..... G09G 3/36 715/760
2015/0325201 A1 * 11/2015 Toba ..... H04N 21/4516 345/520
2016/0021430 A1 * 1/2016 LaBosco ..... H04N 21/4398 725/31
2016/0044273 A1 * 2/2016 Thompson ..... H04N 5/268 348/569
2016/0086567 A1 * 3/2016 Suzuki ..... H04N 21/4122 348/552
2016/0241829 A1 * 8/2016 Qu ..... G09G 5/006
2017/0092226 A1 * 3/2017 Park ..... G09G 5/006
2017/0094344 A1 * 3/2017 Kozuka ..... H04N 21/43635
2017/0115740 A1 * 4/2017 Kim ..... G06F 3/017
2017/0116138 A1 * 4/2017 Yang ..... G06F 13/102
2017/0195722 A1 * 7/2017 Seo ..... H04N 21/44029
2017/0238051 A1 * 8/2017 Park ..... H04N 21/43635 348/730
2017/0244927 A1 * 8/2017 Kim ..... H04N 5/775
2017/0245003 A1 * 8/2017 Lee ..... H04N 21/43635
2017/0280184 A1 * 9/2017 Kozuka ..... H04N 21/40

FOREIGN PATENT DOCUMENTS

KR 10-2009-0132722 12/2009
KR 10-2013-0087356 8/2013
KR 10-1369390 3/2014
KR 10-2014-0043372 4/2014
KR 10-1481547 1/2016
KR 10-1485790 1/2016

* cited by examiner

FIG. 5A

| Byte # | 7 | 6 | 5 | 4 | 3 | 2 | 1 | 0 |
|---|---|---|---|---|---|---|---|---|
| 0 | Vendor-specific tog code(=3) | | | Length(=N) | | | | |
| 1 | 24-bit IEEE Registration Identifier (0x000C03) (least significant byte first) | | | | | | | |
| 2 | | | | | | | | |
| 3 | | | | | | | | |
| 4 | A | | | | B | | | |
| 5 | C | | | | D | | | |
| 6 | Supports_AI | DC_48bit | DC_36bit | DC_30bit | DC_Y444 | Rsvd (0) | Rsvd (0) | DVI_Dual |
| 7 | Max_TMDS_Clock | | | | | | | |
| 8 | Latency_Fields_Present | I_Latency_Fields_Present | HDMI_Video_present | Rsvd (0) | CNC3 | CNC2 | CNC1 | CNC0 |
| (9) | Video_Latency | | | | | | | |

510

520

530

FIG. 5B

| Byte \ Bit # | 7 | 6 | 5 | 4 | 3 | 2 | 1 | 0 |
|---|---|---|---|---|---|---|---|---|
| 0 | Vendor Specific Tag Code (=3) | | | Length (=N) | | | | |
| 1 | IEEE OUI, Third Octet (0xD8) | | | | | | | |
| 2 | IEEE OUI, Second Octet (0x5D) | | | | | | | |
| 3 | IEEE OUI, First Octet (0xC4) | | | | | | | |
| 4 | Version(=1) | | | | | | | |
| 5 | Max_TMDS_Character_Rate | | | | | | | |
| 6 | | | | | | | | |
| 7 | SCDC_ Present | RR_ Capable | Rsvd(0) | Rsvd(0) | LTE_340Mcsc scramble | Independent view | Dual_View | 3D_OSD_ Disparity |
| ···N | Rsvd(0) | Rsvd(0) | Rsvd(0) | Rsvd(0) | Rsvd(0) | DC_48Bit _420 | DC_36Bit _420 | DC_30Bit _420 |

FIG. 6

610

| Data Byte | 0 | ~ | 8 | 9 | A | B | C | D | E | F | 10 | 11 |
|---|---|---|---|---|---|---|---|---|---|---|---|---|
| Character | | | SAM (4C 2D) | | L3E | | | | | | 04 | 07 |
| | | | ID Manufacture Name | | ID Product Code | | ID Serial Number | | | | Week of Manufacture | Year of Manufacture |

| 0 | 0 | 0 | 0 | 0 | 1/0 | 1/0 | 1/0 |
|---|---|---|---|---|---|---|---|
| Reserved | Reserved | Reserved | Reserved | Reserved | BT2020/709 | 6G/3G | 21:9/16:9 |

611 612

FIG. 8A

800

| InfoFrame Type Code | InfoFrame Type = $03_{16}$ | |
|---|---|---|
| InfoFrame Version Number | Version = $01_{16}$ | |
| Length of Source Product Description InfoFrame | Length of Source Product Description InfoFrame = 25 | |
| Data Byte 1 | 0 | Vendor Name Character 1 VN1 (7bit ASCII code) |
| Data Byte 2 | 0 | Vendor Name Character 2 VN2 |
| Data Byte 3 | 0 | Vendor Name Character 3 VN3 |
| Data Byte 4 | 0 | Vendor Name Character 4 VN4 |
| Data Byte 5 | 0 | Vendor Name Character 5 VN5 |
| Data Byte 6 | 0 | Vendor Name Character 6 VN6 |
| Data Byte 7 | 0 | Vendor Name Character 7 VN7 |
| Data Byte 8 | 0 | Vendor Name Character 8 VN8 |
| Data Byte 9 | 0 | Product Description Character 1 PD1(7-bit ASCII code) |
| Data Byte 10 | 0 | Product Description Character 2 PD2 |
| Data Byte 11 | 0 | Product Description Character 3 PD3 |
| Data Byte 12 | 0 | Product Description Character 4 PD4 |
| Data Byte 13 | 0 | Product Description Character 5 PD5 |
| Data Byte 14 | 0 | Product Description Character 6 PD6 |
| Data Byte 15 | 0 | Product Description Character 7 PD7 |
| Data Byte 16 | 0 | Product Description Character 8 PD8 |
| Data Byte 17 | 0 | Product Description Character 9 PD9 |
| Data Byte 18 | 0 | Product Description Character 10 PD10 |
| Data Byte 19 | 0 | Product Description Character 11 PD11 |
| Data Byte 20 | 0 | Product Description Character 12 PD12 |
| Data Byte 21 | 0 | Product Description Character 13 PD13 |
| Data Byte 22 | 0 | Product Description Character 14 PD14 |
| Data Byte 23 | 0 | Product Description Character 15 PD15 |
| Data Byte 24 | 0 | Product Description Character 16 PD16 |
| Data Byte 25 | Source Device Information | |

810

ELECTRONIC DEVICE AND CONTROL METHOD THEREOF

CROSS-REFERENCE TO RELATED APPLICATION

This application is based on and claims priority under 35 U.S.C. § 119 to U.S. Provisional Application No. 62/295,615, filed in the U. S. Patent and Trademark Office on Feb. 16, 2016, and Korean Patent Application No. 10-2016-0065013, filed in the Korean Intellectual Property Office on May 26, 2016, the disclosures of which are incorporated by reference herein in their entireties.

BACKGROUND

1. Field

Aspects of the example embodiments relate generally to an electronic device and a control method thereof and, for example, to an electronic device which supports an HDMI port and a control method thereof.

2. Description of Related Art

Beyond Full High Definition (HD) resolution, as Ultra HD-level resolution content has increased, a sync device equipped with an HDMI port which supports HDMI 2.0 have been actively propagated. However, a source device which is connected to the sync device (e.g., a DVD player, a set-top box, etc.) often cannot support HDMI 2.0 yet.

There has accordingly been a problem that the source device cannot properly recognize Extended Display Identification Data (EDID) which the source device reads from the sync device in the case where a source device which does not support HDMI 2.0 is connected to an HDMI port of a sync device supporting HDMI 2.0. The problem occurs because an HDMI 2.0 sync device has two VSDBs, and in the process where an HDMI 1.4 source device reads EDID of an HDMI 2.0 sync device, an HDMI 1.4 source device stores both VSDBs in one storage area, and a subsequently read VSDB data is overwritten on a previously read VSDB data. As a result, the firstly read VSDB data is lost and not properly read.

SUMMARY

An aspect of the example embodiments relates to an electronic device which, even though a user does not manually set an HDMI version menu which corresponds to an HDMI input port of a sync device, provides an optimal UHD screen or HDR screen by simply connecting an HDMI cable and a control method thereof.

In particular, an aspect of the example embodiments is, that just by connecting an HDMI cable, to process VSDB data not to be lost regardless of a supportable version of HDMI even though a user does not manually set an HDMI menu which corresponds to an HDMI input port of a sync device.

According to an example embodiment, an electronic device providing content from an external device is provided, the electronic device including a memory configured to include a first HDMI version of Extended Display Identification Data (EDID) information, a second HDMI version of EDID information, the second HDMI version being an upgraded version of the first HDMI version, at least one resolution information supportable in the electronic device other than the first HDMI version of EDID information, an external interface configured to communicate with the external device, and a processor configured to cause the first HDMI version of EDID information from among the EDID information and the at least one resolution information to be read by the external device, and to cause the second HDMI version of EDID information to not be read by the external device.

In response to a certain menu related to the external interface being inactive, the processor may cause the second HDMI version of EDID information to not be read by the external device, and to cause the first HDMI version of EDID information to be read by the external device among the EDID information and the at least one resolution information to be read by the external device regardless of whether the certain menu is active.

Here, the first HDMI version of EDID information may be recorded in a first area of the memory, the second HDMI version of EDID information may be recorded in a second area of the memory, and the at least one resolution information may be recorded in a third area of the memory.

The first and the second areas of the memory may be where Vendor-Specific Data Block (VSDB) of HDMI 1.4 version and HDMI Forum (HF)-VSDB of HDMI 2.0 version are recorded, respectively, and the third area is where EDID information may be recorded except for the VSDB of HDMI 1.4 version and the HF-VSDB of HDMI 2.0 version.

The at least one resolution information supportable in the electronic device may be set by a plurality of bits, and at least one bit may comprise resolution information additionally supportable in addition to resolution information supportable in the first HDMI version, and at least one of other bits may comprise color information additionally supportable in addition to color information supportable in the first HDMI version.

In response to the certain menu being deactivated and content of the second HDMI version being input from the external device, the processor may automatically activate the certain menu or provide a UI for alerting a user to activate the certain menu.

In response to Source Product Description (SPD) information whose certain bit has been activated being received from the external device, the processor may automatically activate the certain menu or provide a UI for alerting a user to activate the certain menu.

Meanwhile, according to an example embodiment, an electronic device providing content, including an external interface configured to communicate with an external device which stores a first HDMI version of Extended Display Identification Data (EDID) information, a second HDMI version of EDID information, the second HDMI version being an upgraded version of the first HDMI version, and at least one resolution information supportable in the electronic device other than the first HDMI version of EDID information and a processor configured to read the first HDMI version of EDID information from among the EDID information stored in the external device and the at least one resolution information stored in the external device, to not read the second HDMI version of EDID information, and to provide content supportable in the sync device based on the read information.

Here, in response to a certain menu related to the external interface being inactive, the external device may cause the second HDMI version of EDID information to not be read by the source device, and to cause the first HDMI version of EDID information to be read by the external device, and the at least one resolution information to be read by the external device regardless of whether the menu is active.

When the first HDMI version of EDID information and the at least one resolution information are read by the external device, but the second HDMI version of EDID information is not read by the external device, the processor may detect that the menu is inactive, and automatically activate the menu or transmit to the sync device a control signal to provide a user with a UI for alerting a user to activate the certain menu.

According to an example embodiment, a method of controlling the electronic device that stores a first HDMI version of Extended Display Identification Data (EDID) information, the second HDMI version of EDID information, the second HDMI version being an upgraded version of the first HDMI version and, at least one resolution information supportable in the electric apparatus other than the first HDMI version of EDID information, the method, including determining whether to activate a certain menu when an event where an external device is connected to an external interface occurs, and transmitting the at least one resolution information to the external device regardless of whether the certain menu is active, and, when the certain menu is inactive, causing the second HDMI version of EDID information to not be read by the external device, and causing the first HDMI version of EDID information to be read by the external device from among the EDID information.

The first HDMI version of EDID information may be recorded in a first area of the memory equipped in the electronic device, the second HDMI version of EDID information may be recorded in a second area of the memory, and the at least one resolution information may be recorded in a third area of the memory.

Here, the first and the second area of the memory may be where Vendor-Specific Data Block (VSDB) of HDMI 1.4 version and HF-VSDB of HDMI 2.0 version are recorded, respectively, and the third area of the memory may be where EDID information is recorded except for the VSDB of HDMI 1.4 version and the HF-VSDB of HDMI 2.0 version.

At least one resolution information supportable in the electronic device may be set by a plurality of bits, and at least one bit may comprise resolution information additionally supportable in addition to resolution information supportable in the first HDMI version in the electronic device, and at least one of other bits may comprise color information additionally supportable in addition to color information supportable in the first HDMI version.

The method may further include, in response to the certain menu being inactive and an input of content of the second HDMI version being received from the external device, automatically activating the certain menu or providing a UI for alerting a user to activate the certain menu.

The method may further include, when Source Product Description (SPD) information whose certain bit has been activated is received from the external device, automatically activating the certain menu or providing a UI for alerting a user to activate the certain menu.

According to an example embodiment, a recording medium in which a program to perform a method of controlling the electronic device which stores a first HDMI version of Extended Display Identification Data (EDID) information, a second HDMI of EDID information, the second HDMI version being an upgraded version of the first HDMI version and, at least one resolution information supportable in the electric apparatus other than the first HDMI version of EDID information, the method includes:

Determining whether to activate a certain menu when an event where an external device is connected to an external interface occurs and, when the certain menu is inactive, causing the at least one resolution information to be read by the external device regardless of whether the certain menu is active, and the second HDMI version of EDID information to not be read by the external device, and causing the first HDMI version of EDID information to be read by the external device from among the EDID information.

As described above, according to the various example embodiments, even though a user does not manually set a menu for converting EDID information in relation to HDMI version of TV, a user can watch an optimal UHD screen or HDR screen just by connecting an HDMI cable when connecting a source device which supports HDMI 2.0 version.

BRIEF DESCRIPTION OF THE DRAWINGS

These and other features and aspects of the disclosure will be more readily apparent and understood from the following detailed description, taken in conjunction with the accompanying drawings, in which like reference numerals refer to like elements, and wherein:

FIG. 5A and FIG. 5B are diagrams illustrating example structures of VSDB of HDMT 1.4 version and VSDB of HDMI 2.0 version according to different HDMI standards;

FIG. 6 is a illustrating an example storage area in which additional information is recorded according to an example embodiment;

FIG. 8A and FIG. 8B are diagrams illustrating example SPD information according to an example embodiment;

DETAILED DESCRIPTION

Hereinafter, example embodiments will be described in greater detail with reference to the accompanying drawings.

Figure 1:
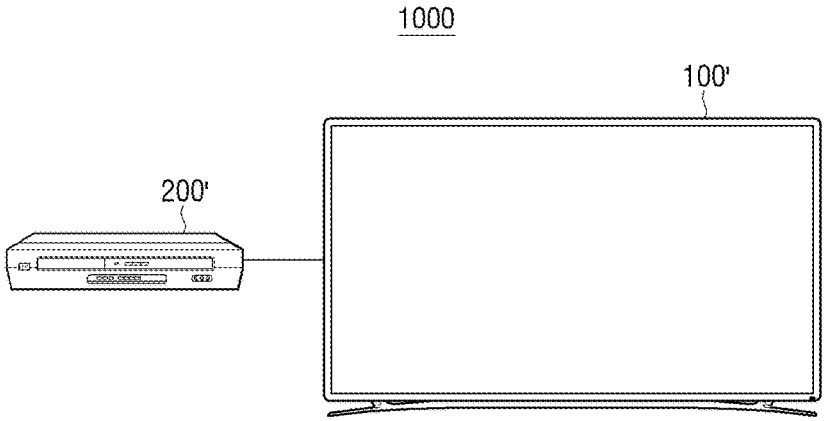
FIG. 1 is a diagram illustrating an example configuration of an electronic system according to an example embodiment.

FIG. 1 is a diagram illustrating an example electronic system according to an example embodiment.

As illustrated in FIG. 1, a content providing system 1000 includes a sync device 100' and a source device 200.'

The source device 200' provides content to the sync device 100'. For example, the source device 200' may be implemented through various forms of an electronic device which can provide content to the sync device 100' such as a set-top box, a DVD player, a Blu-ray disc player, a PC, a game player, and the like. The sync device 100' may be implemented through various forms of an electronic device which can output content received from the source device 200' such as a network TV, a smart TV, an internet TV, a web TV, an Internet Protocol Television (IPTV), a signage, a PC, and the like, but is not limited thereto.

In particular, the sync device 100' may be implemented by a device which supports High-speed Multimedia Interface (HDMI). Accordingly, the sync device 100' and the source device 200' are equipped with an HDMI port, and may communicate with each other through the port. As an example, the sync device 100' and the source device 200' may be equipped with an HDMI 2.0 port. For example, HDMI 2.0 is a standard optimized for a high resolution environment called 4K or Ultra HD (UHD). A maximum bandwidth has increased up to 18 Gbps, and a video smoothly processed at 60 Hz in resolution of 4,096×2,160 (2160p) at most can be transported. In addition, in 2015, HDMI 2.0a with a High-dynamic-range (HDR) video support rendering a clearer video image by improving contrast distinction and color gamut was released. HDMI 2.0 standard here includes HDMI 2.0a standard.

For example, the source device 200' may provide corresponding content to the sync device 100' based on EDID information received from the sync device 100.' EDID is a standard for transmitting a display information from the sync device 100,' a display part, to the source device 200,' a host part. EDID here is not to define an interface signal such as a data channel (DDC), but to define a data format so as to cause a host part to read a displaying ability. EDID may include information regarding a name of manufacturing company, a manufacturing date/year, a type of product, an EDID version, resolution and color coordinates of a product, a type of phosphor and a type of filter, a timing, a screen size, luminance, pixels, and the like.

For example, in HDMI standard, it is implemented that resolution information and color information of the sync device 100' are stored through Vender Specific Data Block (VSDB), and the source device 200' extracts VSDB information and transmits corresponding content to the sync device 100.' However, according to an example embodiment, the sync device 100' may store additional color information and resolution information in a memory other than Vender Specific Data Block (VSDB) which defines resolution information and color information in HDMI standard. Then, the source device 200' may read the stored information, and receive and output corresponding content.

Hereinafter, example embodiments will be described in greater detail with reference to the accompanying drawings.

Figure 2:
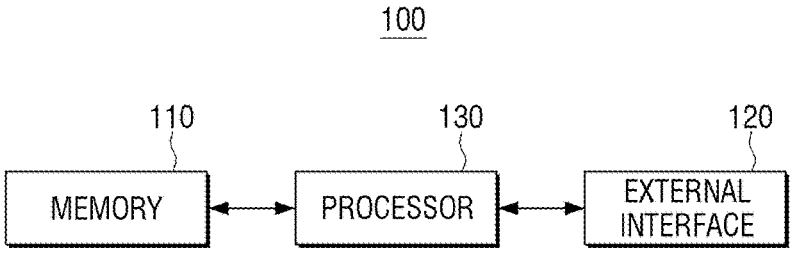
FIG. 2 is a block diagram illustrating an example configuration of an electronic device according to an example embodiment.

FIG. 2 is a block diagram illustrating an example configuration of an electronic device according to an example embodiment.

As illustrated in FIG. 2, an electronic device 100 includes a memory 110, an external interface 120 and a processor 130. For example, an electronic device may be implemented by the sync device 100' illustrated in FIG. 1.

The memory 110 may include, for example, a first HDMI version of Extended Display Identification Data (EDID) information, a second HDMI version of EDID information, and at least one resolution information additionally supportable in the electronic device 100 other than the first HDMI version of EDID information. For example, the second HDMI version may be an upgraded version of the first HDMI version.

For example, the memory 110 may include a first area where a first HDMI version of EDID information is recorded, a second area where a second HDMI version of EDID information, the second HDMI version being an upgraded version of the first HDMI version, is recorded, and a third area where an additional resolution information supportable in the electronic device 100 in addition to resolution and color information supported in the first HDMI version is recorded. For example, the first and the second areas may be implemented by Vendor-Specific Data Block (VSDB) of HDMI 1.4 version (hereinafter, VSDB 1.4) (referring to FIG. 5A) and HDMI Forum (HF)-VSDB of HDMI 2.0 version (hereinafter, VSDB 2.0) (referring to FIG. 5B), respectively, which are defined in HDMI standard. Here, specification information supportable in the third area may be consistent with specification information stored in the second area.

Here, information block called Vender Specific Data Block (VSDB), for instance, referring to VSDB 1.4 illustrated in FIG. 5A, classifies blocks using an IEEE code, and includes CEC Physical address information 510, Color bit information 520, maximum TMDS frequency information 530, Audio/Video Latency information, and the like. Here, Color bit information 520 may refer, for example, to color information, and maximum Transition Minimized Differential Signaling (TMDS) frequency information may refer, for example, to resolution information because the higher the maximum TMDS clock frequency, the more the amount of data which can be transmitted, and high resolution data can be transmitted accordingly. Based on VSDB which includes these information, the external device 200 may determine what kind of a signal format the electronic device 100 can receive and output through an HDMI port, and transmit content corresponding to the signal format.

The third area of the memory 110 may be implemented by a plurality of bits but not limited to the case, and may be implemented through one bit or more than three bits depending on stored information. As an example, in the case in which the third area is implemented through two bits, one bit includes an information additionally supportable in addition to resolution information supportable in HDMI 1.4 in the electronic device 100, and the other bit includes color information additionally supportable in addition to resolution information supportable in HDMI 1.4. Here, to include information additionally supportable covers both the cases of including information supportable in HDMI 1.4 along with information additionally supportable and of including only the information additionally supportable except for the information supportable in HDMI 1.4. The former case or the latter case may be implemented depending on different example embodiments. Furthermore, to include information additionally supportable may also include the case in which specification information supportable in the third area may be consistent with specification information stored in the second area.

The third area may be a VSDB external area described above. As an example, as illustrated in FIG. 6, the third area may be a part of an assigned area in which an ID Serial Number is to be recited according to different HDMI standards. For example, the third area may be set by a second and a third bit values 611 and 612 of ODh area 610 among the areas assigned to recite an ID Serial Number, but it is not limited to this one example. Other reserved areas besides VSDB may also be used as a third area.

As an example, a second bit of the third area indicates that a TMDS transmission data frequency of HDMI is 3 Ghz or 6 Ghz at maximum. For instance, the value "1" may indicate that a maximum frequency of TMDS transmission data is 6 Ghz, and the value "0" may indicate that a maximum frequency of TMDS transmission data is 3 Ghz, or reversely, the value "1" may indicate 3 Ghz, and the value "0", 3 Ghz.

Here, if a maximum frequency of TMDS transmission data is 3 Ghz, it means that resolutions of 480p/720p/1080i @60 Hz/50 Hz, 1080p @ 24 Hz/25 Hz/30 Hz/60 Hz 8 bit-12 bit and 4K 420 @ 60 Hz 8 bit, 4K 444/422 @ 24/25/30 Hz 8 bit may be processed. Furthermore, if a maximum frequency of TMDS transmission data is 6 Ghz, it means that resolutions of 480p/720p/1080i @ 60 Hz/50 Hz, 1080p @ 24 Hz/25 Hz/30 Hz/60 Hz 8 bit-12 bit, 4K 420 @ 60 Hz 8 bit, 4K 444/422 @ 24/25/30 Hz 8 bit-12 bit and 4K 444 @ 60 Hz 8 bit may be processed.

A third bit of a third area indicates whether color gamut that a HDMI terminal supports is BT2020 or BT709. For instance, a value "1" indicates that supportable color gamut is BT2020, and a value "0" indicates that supportable color gamut is BT709, or reversely, a value "1" may indicate BT709, and a value "0", BT2020. Meanwhile, data bit depth is automatically defined according to different color gamut. If color gamut is BT2020, up to 10 bit is supportable, and if Color gamut is BT709, up to 8 bit is supportable.

Meanwhile, the memory 110 may include one type of storage media among a flash memory type, ROM (for example, EEPROM etc.), RAM, a hard disk type, a multimedia card micro type and a card type (for example, an SD or an XD memory, etc.).

The external interface 120 communicates with an external device (not illustrated). The external device (not illustrated) here may be implemented by the source device 200' illustrated in FIG. 1. Hereinafter, the case in which the external device is implemented by the source device 200' illustrated in FIG. 1 would be presupposed and described as an example.

The external interface 120 may be implemented by an HDMI port which can receive a high resolution video and a multichannel digital audio through one cable. Specifically, the external interface 120 includes a Transition Minimized Differential Signaling (TMDS) channel receiving a video signal and an audio signal, Display Data Channel (DDC) receiving device information and information related to a video or an audio (e.g., Enhanced Extended Display Identification Data [E-EDID]) from the external device 200' connected and Consumer Electronic Control (CEC) which can transmit a control signal to the external device 200.'

In particular, the external interface 120 may be implemented by an HDMI 2.0 input port which supports HDMI 2.0 standard. Here, each version of an HDMI port has backward compatibility. Hence, it is possible to connect a source device of high level standard to an output device of low level standard, or to connect a source device of low level standard to an output device of high level standard. However, in the latter case, both devices can use low standard functions only. As an example, even though the electronic device 100 (for example, TV) supports HDMI 2.0, but if the external device 200' (e.g., a Blu-ray player) is HDMI 1.4 standard, only HDMI 1.4 functions can be used.

The processor 130 controls overall operations of the electronic device 100. Here, the processor 130 may include various processing circuitry, such as, for example, and without limitation, one or more processor(s) among a central processing unit (CPU), a controller, an application processor (AP), a communication processor (CP) and an ARM processor, or the like.

The processor 130, depending on a predetermined event, causes EDID information of a second version to not be read by the external device 200,' but causes only EDID information of a first version and at least one resolution information to be read by the external device 200' among EDID information stored in the memory 100. Here, as described above, EDID information of the first HDMI version may be recorded in a first area of the memory, EDID information of the second HDMI version may be recorded in a second area of the memory, and at least one resolution information may be recorded in a third area of the memory.

In the above case, the processor 130, depending on a predetermined event, controls data stored in a second area to not be read by the external device 200', but data stored in a first and in a third area to be read by the external device 200' among the data stored in the memory 110. Here, the predetermined event may be an event where the external device 200' is connected to the external interface 120. For instance, it may be an event where an HDMI cable terminal of the external device 200' is connected to the external interface 120 implemented by an HDMI terminal, but not limited to this one example. As another example, depending on implementation, it may be an event of selecting a respective terminal through a menu after connecting an HDMI terminal.

However, in order to implement this service, the external device 200' should know a location of the third area and what type of data is recorded in the third area beforehand. In other words, according to the HDMI standard, respective information is not recorded in the third area, thus, the external device 200' should know in advance that resolution and color information are recorded in the third area. For example, if "ID Manufacture Name" indicates a certain manufacturing company, the external device 200' may recognize that the certain manufacturing company records resolution information in the third area, extract a value recorded in the third area, and transmit a corresponding content to the electronic device 100 based on the extracted value. In addition, in the third area, a portion of an assigned area in which an ID Serial Number is recited may become a reserved area according to different HDMI standards, and if an ID Serial Number represents a certain manufacturing company, the external device 200' may check the value recorded in the respective reserve area, and obtain resolution and color information.

Figure 7:
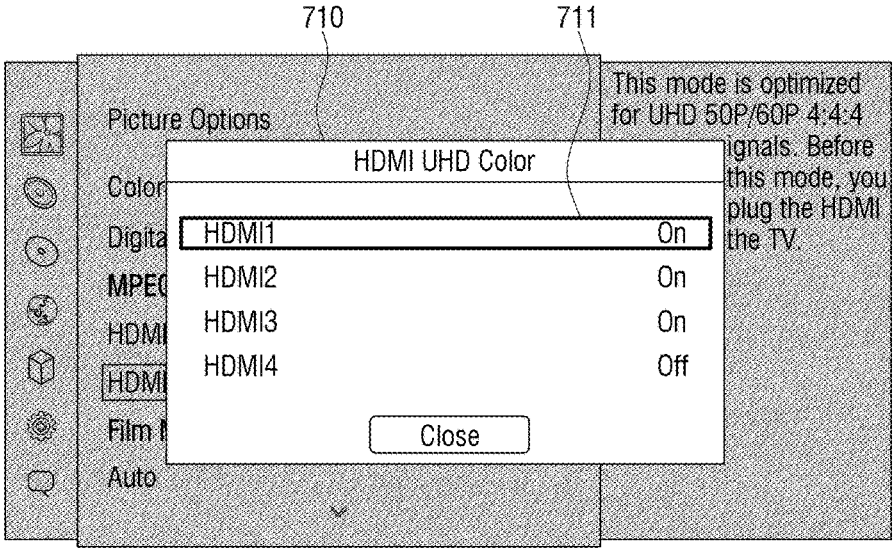
FIG. 7 is a diagram illustrating an example menu for setting HDMI UHD Color according to an example embodiment.

The processor 130 may control data recorded in the first and the second areas to be read by the external device 200' when a certain menu is active, which means that a certain menu is set to ON, and, when a certain menu is inactive, which means that a certain menu is set to OFF, the processor 130 may control data recorded in the second area to not be read by the external device 200' but only the data recorded in the first area to be read by a source device. Here, a certain menu may be a menu 710 related to a HDMI UHD Color setting as illustrated in FIG. 7, and may be implemented to set ON/OFF according to each HDMI port. However, the third area is an area besides VSDB, that is, an area read by the external device 200' according to different HDMI standards regardless of whether the respective menu is active or not.

Therefore, when a respective menu is deactivated, only the data recorded in the first and the third areas are read by the external device 200,' and the data recorded in the second data turns into a state in which the data recorded in the second area may not be read by the external device 200'.

Related to the feature above, an HDMI 2.0 sync device is released to the market with a respective menu being inactive, and a user may set whether to activate a menu according to specification of an external device, in other words, a user may set ON/OFF state of a menu. The reason is as follows.

According to HDMI standard, if a sync device has more than two VSDBs, that is, if a sync device has VSDB of HDMI 1.4 version (hereinafter, VSDB 1.4) and VSDB of HDMI 2.0 (hereinafter VSDB 2.0), a source device should clearly distinguish and identify respective information by checking an IEEE code of each VSDB and reading the codes separately.

However, an HDMI source device currently released to the market is configured to read VSDB 1.4 and then to read VSDB 2.0 consecutively. Thus, when an HDMI 1.4 source device is connected to an HDMI 2.0 sync device, VSDB 2.0 overwrites on previously read VSDB 1.4, and VSDB 1.4 data is eventually damaged. For example, No. 4 bit of the sixth bite in VSDB 1.4 (FIG. 5A) is bit information which indicates whether TV supports 30 bit or not, but VSDB 2.0 (FIG. 5B) overwrites on the VSDB 1.4 information, and a Rsvd (0) value which is No. 4 bit of the sixth bite in VSDB 2.0 is stored. As a result, every bit information of VSDB 1.4 is substituted with each respective bit information of VSDB 2.0 existing in the same area.

Consequently, the HDMI source device determines what kind of a function the connected sync device provides using the damaged VSDB information. As the source device determines an HDMI standard which the sync device supports using the damaged VSDB information, the source device outputs a signal based on the wrong specification information of TV. Due to this problem, there arise problems that a sound and a certain resolution are not outputted, or wrong color bit is set and outputted, or the like. This is because the source device determines based on the damaged VSDB information that the connected sync device cannot support audio, or that the sync device cannot supports high resolution because a maximum TMDS frequency is low.

In other words, the above described problem emerges because VSDB 1.4 and VSDB 2.0 use different IEEE codes from each other (for example, IEEE OUI in VSDB 2.0 is 0xC4, Ox5D and 0xD8, and IEEE OUI in VSDB 1.4 is 0x03, 0x0C and 0x00), but existing HDMI 1.4 source devices are not designed to distinguish different HDMI VSDBs.

In order to solve the problem above, HDMI 2.0 is basically designed to provide VSDB 1.4 information only, and to provide VSDB 2.0 for a port to which an HDMI 2.0 source device is connected if a user activates the certain menu mentioned above. Therefore, because an HDMI 2.0 source device is designed to distinguish VSDB 1.4 and VSDB 2.0 and processes VSDB 1.4 and VSDB 2.0 simultaneously, it is designed that a conversion is performed only for an HDMI input port to which an HDMI 2.0 source device is connected using a manual setting menu. Thus, as a respective menu is inactive when an HDMI 1.4 source device is connected, only VSDB 1.4 information is transmitted to an HDMI 1.4 source device, thereby preventing the above-described problem.

Therefore, according to an example embodiment, the electronic device 100 is also configured to employ a general implementation format of an HDMI 2.0 sync device which causes VSDB 2.0 data to not be read by the external device 200' if the certain menu is deactivated.

Specifically, the processor 130 may cause all VSDB 1.4 information and VSDB 2.0 to be transmitted to a source device if a respective menu is activated, and if the respective menu is deactivated, the processor 130 may cause only VSDB 1.4 to be read by the external device 200.'

In this respect, according to an example embodiment, the memory 120 may be separately equipped with a first EEPROM which stores all VSDB 1.4 and VSBB 2.0 and a second EEPROM which stores only VSDB 1.4. In this case, the processor 130 may control the external device 200' to read the first EEPROM data if the respective menu is activated, and if the menu is deactivated, the processor may control the external device 200' to read the second EEPROM data.

According to another example embodiment, the processor 130 may change data recorded in the memory 120 may change the data recorded in EEPROM. Specifically, the processor 130 may store VSDB 1.4 and VSDB 2.0 in EEPROM if the respective menu is activated, and if the respective menu is deactivated, the processor 130 may store VSDB 1.4 in EEPROM.

Meanwhile, the processor 130 may automatically convert a respective menu to be activated, or provide a UI for alerting (or recommending) a user to convert a respective menu to be activated according to the controlling performed in the source device 200 while the respective menu is inactive, and a signal related to the second version (e.g., an HDR signal or a 2160p 4:4:4 60 Hz signal) is inputted from the source device 200. The reason is that, although the respective menu is inactive, that is, although the source device 200 has read only VSDB 1.4 except for VSDB 2.0, in the case in which the source device 200 reads resolution information and color information of the third area together according to an example embodiment, it means that the sync device 100 is an HDMI 2.0 device. Thus, the source device 200 may transmit a control signal for activating the respective menu to the sync device 100, or transmit a control signal to provide a UI for alerting a user to convert the respective menu to be activated.

Moreover, the processor 130 may automatically convert a respective menu to be activated or provide a UI for alerting a user to convert the respective menu to be activated while the respective menu is inactive, but a signal related to the second version (e.g., an HDR signal) is inputted from the source device 200. The reason is that, although the respective menu is inactive, that is, although only VSDB 1.4 except for VSDB 2.0 is transmitted to the source device 200, the fact that a signal related to the second version (e.g., an HDR signal or a 2160p 4:4:4:60 Hz signal), that is a signal related to HDMI 2.0, is inputted from the source device 200 means that the source device 200 has read resolution information and color information of the third area, in other words, that the sync device 100 is an HDMI 2.0 device according to an example embodiment. Thus, the processor 130 may automatically convert the respective menu to be activated, or provide a UI for alerting a user to convert the respective menu to be activated.

Further, the processor 130 may provide a UI for alerting a user to activate the respective menu when Source Product Description (SPD) information with certain bit being activated is received from the external device 200.' Here, Source Product Description (SPD) Infoframe (FIG. 8A, 800) comprises 25 bites to provide detailed information of a source product to the sync device.

Figure 8B:
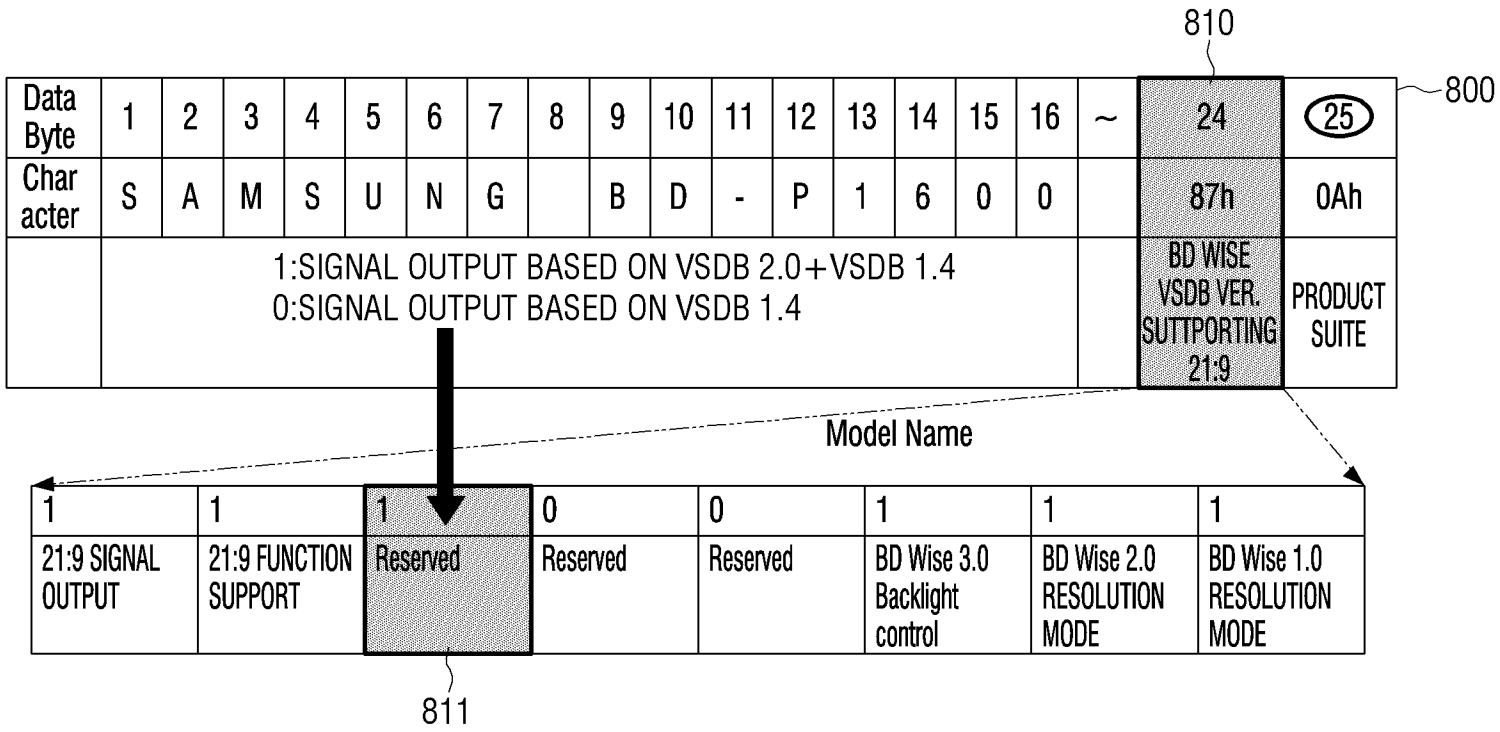
Figure 9:
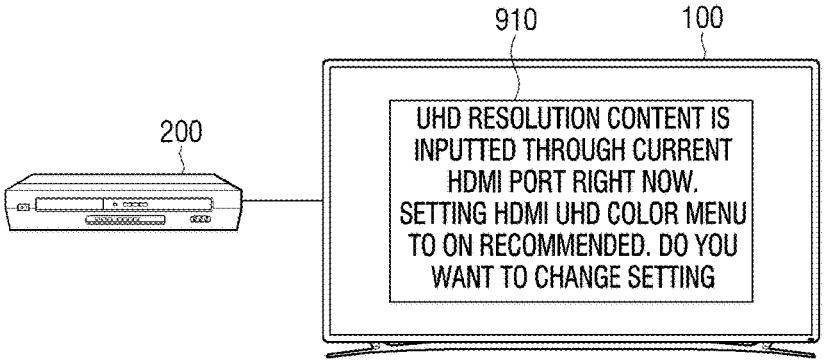
FIG. 9 is a diagram illustrating an example UI alert according to an example embodiment.

For example, according to FIG. 8B, an audio content bit of an DB Wise Ver 3.0 function and a reserve bit (821-1) of 24th bite which transmits a backlight control bit may be used as certain bits, but not limited to this case. In other words, as illustrated in 8B, when the processor 130 receives Source Product Description (SPD) information with a certain bit (821-1) activated as "1," the processor 130 may detects that the external device 200' outputs content based on VSDB 2.0 and VSDB 1.4. In this case, if the respective menu has been set to OFF, a UI for alerting a user to change the respective menu setting to ON may be provided. FIG. 9 illustrates the case in which a UI alert (910) is provided according to various example embodiments described above.

Meanwhile, according to another example embodiment, the external device 200' may not be able to read data of the third area, but if the external device 200' reads information of a fourth area which is information that supports HDR content through HDMI 2.0a, the external device (200') determines that HDMI 2.0 can be supported. If the respective menu is inactive, the external device 200' may transmit a control signal to provide a UI for alerting a user to convert the respective menu to be activated to the electronic device 100, or transmit a control signal for converting the respective menu to be activated to the electronic device 100.

Meanwhile, in respect to the interface 120 of the electronic device 100, in the case in which a format supportable by an HDMI port is limited to VSDB 1.4, and only VSDB 1.4 has been recorded in the memory 100, and if the respective menu is activated as ON according to an example embodiment, the processor 130 may change an input setting and an input specification of an HDMI port in order for an HDMI port to receive the specification described in HDMI 2.0 VSDB. In other words, the processor 130 may add VSDB 2.0 standard information into VSDB 1.4 information using 2 bits, and an input setting and an input specification of an HDMI port are also changed accordingly. Consequently, even though the electronic device 100 has stored only VSDB 1.4, 2160p/60 Hz 4:4:4 (resolution), 10 bit (data bit depth) and BT.2020 (color gamut) signals of VSDB 2.0 may be received as the electronic device 100 activates a respective menu as ON.

Figure 3:
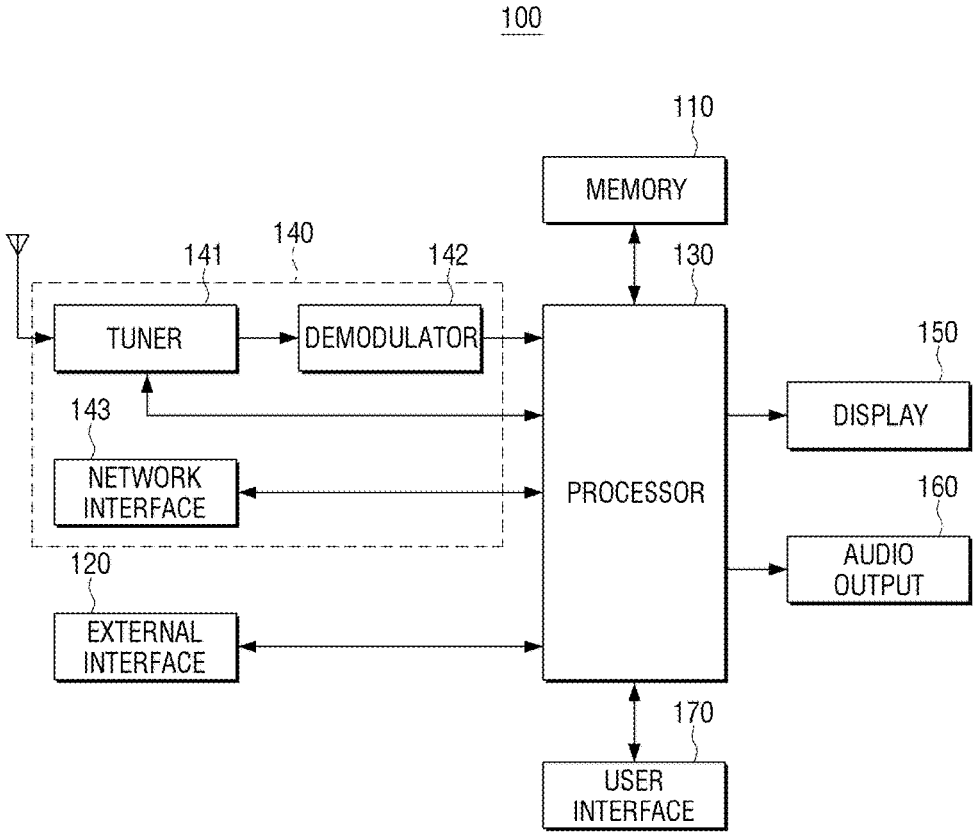
FIG. 3 is a block diagram illustrating an example configuration of an electronic device illustrated in FIG. 2.

FIG. 3 is a block diagram illustrating an example configuration of the electronic device illustrated in FIG. 2.

According to FIG. 3, the electronic device 100 includes the memory 110, the external interface 120, the processor 130, a receiver 140, a display 150, an audio output (e.g., including audio output circuitry) 160 and a user interface 170. Among the configurations illustrated in FIG. 3, the description for the part of configuration overlapped with the configuration illustrated in FIG. 2 will be omitted.

The external interface 120 further includes various cable/wireless interfaces which can be linked with the external device in addition to the HDMI ports described above. For example, the external interface 120 may include a cable interface such as a USB terminal, a Composite Video Banking Sync (CVBS) terminal, a component terminal, a S-video terminal (analog), a Digital VisualInterface (DVI) terminal, and a wireless interface which uses a communication protocol such as Wireless LAN (WLAN), Wireless-Fidelity (Wi-Fi), Wireless Fidelity (Wi-Fi) Direct, Bluetooth, Radio Frequency Identification (FID), Infrared Data Association (IrDA), UltraWideband (UWB), ZigBee, Digital Living Network Alliance (DLNA), and the like.

The memory 110 may store a program to process and to control each signal inside the processor 130, and may store an image processed into a signal, a sound signal and a data signal. In addition, the memory 110 may work as a transitory storage for an image signal, a sound signal or a data signal input from the external interface 120 or from a network interface 143.

The receiver 140 may include various circuitry, such as, for example, and without limitation, at least one tuner 141, one demodulator 142 and one network interface 143. In some cases, the receiver 140 may be equipped with the tuner 141 and the demodulator 142 but may not include the network interface 143, or equipped with the network interface 143 but not include the tuner 141 and the demodulator 142. The tuner 141 receives an RF broadcasting signal by tuning every channel selected by a user or pre-stored channel among Radio Frequency (RF) broadcasting signals received through an antenna. The demodulator 142 may receive and demodulate a digital IF signal (DIF) converted in the tuner 141, and may decode a channel.

The network interface 143 uses various communication interface circuitry to provide an interface to connect the electronic device 100 to a cable/wireless network which includes an internet network. The network interface unit 143 may be equipped with a terminal such as an Ethernet terminal in order to access to a cable network, and may use a communication standard such as WirelessLAN (WLAN), Wireless Fidelity (Wi-Fi), Wireless broadband (Wibro), World Interoperability for Microwave Access (Wimax), High Speed Downlink Packet Access (HSDPA), or the like in order to access to a wireless network.

The display 150 converts an image signal processed in the processor 130, a data signal, an OSD signal or an image signal received from the external interface 120, a data signal, and the like into R, G, B signals, respectively, and generates an operation signal. The display 150 may be implemented through PDP, LCD, OLED, a flexible display, a 3D display, a touch screen, or the like.

The audio output 160 includes various audio output circuitry that receives an audio signal processed in the processor 130 such as a stereo signal, a 3.1 channel signal or a 5.1 channel signal, and outputs the signal as an audio. The audio output unit 160 may be implemented through various forms of speakers.

The user interface 170 transmits a command inputted by a user to the processor 130, or transmits a signal from the processor 130 to a user. For example, the user interface 170 may be implemented in a form of communicating with a remote control apparatus (not illustrated) or implemented in a form of a key panel equipped in the electronic device 100 depending on various communication methods such as an RF communication method, an IR communication method, or the like.

Figure 4:
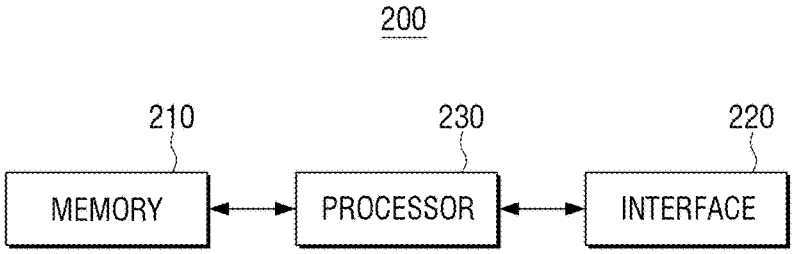
FIG. 4 is a block diagram illustrating an example configuration of an external device according to an example embodiment.

FIG. 4 is a block diagram illustrating an example configuration of the external apparatus according to an example embodiment.

According to FIG. 4, the external 200 includes a memory 210, an interface 220 and a processor 230. Here, the external device 200 may be implemented by a source device 200' illustrated in FIG. 1.

The memory 210 temporarily or permanently stores information received from the electronic device 100.

The interface 220 includes various communication circuitry that communicates with the electronic device 100. Here, the electronic device 100 may be implemented through the sync device 100' illustrated in FIG. 1.

The external interface 220 may be implemented by an HDMI port which can transmit a high resolution video and a multichannel digital audio through one cable by the electronic device 100.

The processor 230 does not read EDID information of the second HDMI version, but reads EDID information of the first HDMI version from among EDID information stored in the electronic device 100 and at least one resolution information according to a pre-set event, and provides content supportable in the electronic device 100 to the electronic device 100 based on the read information.

Specifically, the processor 230 reads Extended Display Identification Data (EDID) information of the first HDMI version which is in the memory 110 of the electronic device 100 and resolution information and color information supportable in the electronic device 100 which are recorded in the third area according to a pre-set event. Then, based on respective information, the processor 230 determines a final signal format supportable in the electronic device 100. Here, the pre-set event may be an event where the interface 220 is connected to the electronic device 100. For example, the pre-set event may be an event where an HDMI cable terminal of the electronic device 100 is connected to the interface 220 which is implemented by an HDMI terminal, but not limited to this one example. As another example, in some example embodiment, it may be an event of selecting the interface 220 implemented by an HDMI terminal through a menu provided in the electronic device 100 after an HDMI terminal is connected.

For example, as EDID information of the HDMI 1.4 version is recorded in a first area, and resolution information and color information corresponding to HDMI 2.0 version are recorded in a third area, the processor 130 may determine that the electronic device 100 can support not only HDMI 1.4 version (2160p/60 Hz 4:2:0, 8 bit, BT.709) but also HDMI 2.0 version (2160p/60 Hz 4:4:4, 10 bit, BT.2020).

As described above, the external device 200 determines that HDMI 2.0 version, that is, 2160p/60 Hz 4:4:4 (resolution), 10 bit (data bit depth) and BT.2020 (color gamut), is supportable, and outputs a signal with a specification for the electronic device 100 to implement the best resolution quality supportable based on the supportable version determined. However, in order to implement this service, the external device 200 should also be implemented by a source device which supports HDMI 2.0 version.

When EDID information of the first HDMI version and at least one resolution information are read by the electronic device 100, but the second HDMI version of EDID information is not read by the electronic device 100, the processor 230 may detect that a respective menu is inactive in the electronic device 100, and then transmit to the electronic device 100 a control signal for automatically activating the respective menu, or transmit a control signal to provide a UI for alerting a user to activate the certain menu. In other words, in the case in which VSDB 1.4 information in the first area and resolution information and color information in the third area are read together, the processor 230 may determine that the electronic device 100 is an HDMI 2.0 device, and that the respective menu needs to be activated.

Further, in the case in which the processor 230 transmits corresponding content to the electronic device (100) based on VSDB 1.4 information and information that two bits of the third area read by the electronic device 100, the processor 230 may inform the electronic device 100 that a currently transmitted signal is being transmitted with a higher-level specification than VSDB 1.4, that is, the specification shown in actual EDID information, by assigning some bits of SPD (Source Product information) Infoframe. In this case, when the respective signal is transmitted, the electronic device 100 automatically activates an HDMI UHD Color menu to ON, or provides a UI which suggests setting a menu to ON.

Figure 10:
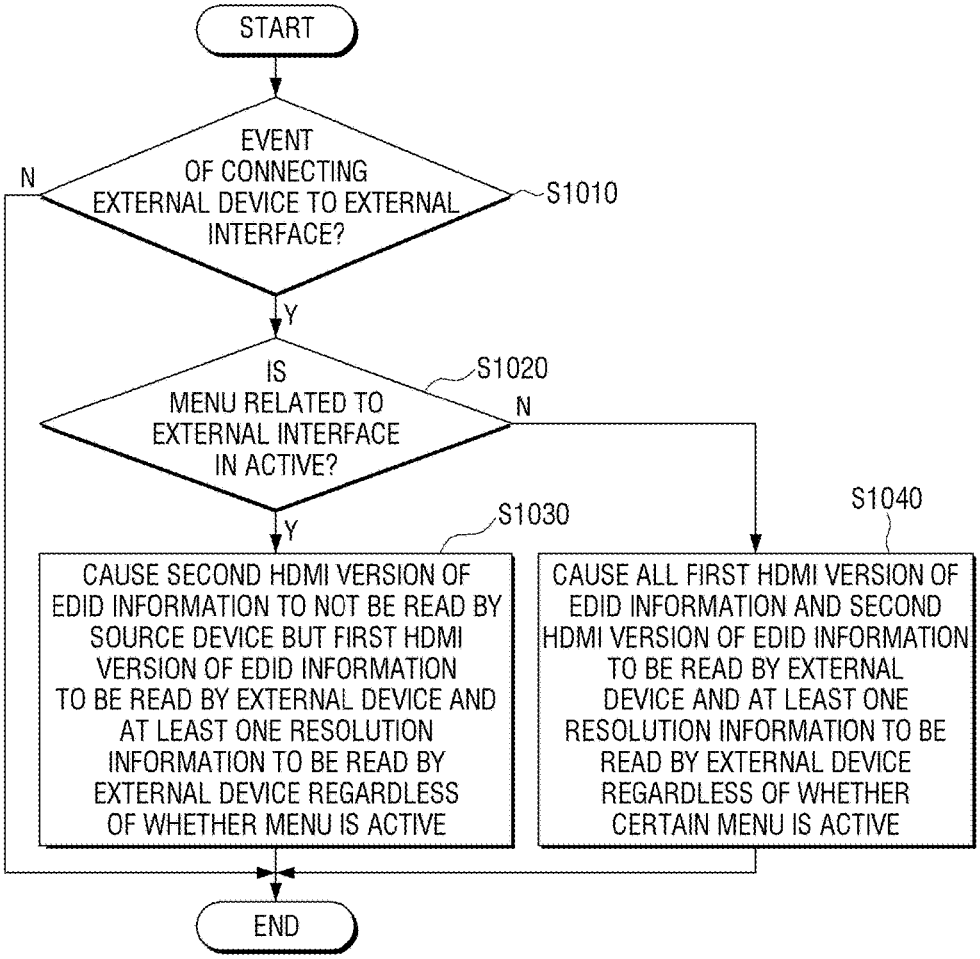
FIG. 10 is a flowchart illustrating an example method of controlling an electronic device according to an example embodiment.

FIG. 10 is a flowchart illustrating an example method of controlling an electronic device according to an example embodiment.

The electronic device 100 according to an example embodiment may include a memory configured to include Extended Display Identification Data (EDID) information of a first HDMI version, EDID information of a second HDMI version, the second HDMI version being an upgrade version of the first HDMI version, and, at least one resolution information additionally supportable in the electronic device other than the first HDMI version of EDID information. Here, the EDID information of the first HDMI version may be recorded in a first area of the memory, the second HDMI version of EDID information may be recorded in a second area of the memory, and the at least one resolution information may be recorded in a third area of the memory.

According to the flowchart illustrated in FIG. 10, when an event where an external device is connected to an external interface occurs (S1010:Y), the electronic device determines whether a menu related to an interface is active or not. If a respective menu is inactive (S1020:Y), the electronic device causes data recorded in the second area to not be read by an external device, but only data recorded in the first area to be read by the external device among EDID information stored in the memory, and transmits data recorded in the third area to the external device regardless of whether the respective menu is active.

Moreover, if the respective menu is active (S1020:N), the electronic device causes all the data recorded the first and the second area to be read by the external device, and causes the data recorded in the third area to be read by the external device regardless of whether the respective menu is active.

Here, the first and the second areas may be where Vendor-Specific Data Block (VSDB) of HDMI 1.4 version and HF-VSDB of HDMI 2.0 version are recorded, respectively, and the third area of the memory is where EDID information is recorded except for the VSDB of HDMI 1.4 version and the HF-VSDB of HDMI 2.0 version.

The third area may be set by at least one bit. For example, in the case in which the third area is set by two bits, one bit may include resolution information additionally supportable in addition to resolution information supportable in HDMI 1.4 version, and the other bit may include color information additionally supportable in addition to color information supportable in the HDMI 1.4 version in the electronic device.

The method may further include automatically activating the certain menu or providing a user with a UI for alerting a user to activate the certain menu when the certain menu is inactive, but an input of content of the second version is received from the external device.

Moreover, the method may further include automatically activating the certain menu or providing a user with a UI for alerting a user to activate the certain menu when Source Product Description (SPD) information with certain bit being activated is received from the external device.

Meanwhile, the electronic device may be implemented by a sync device which supports the second version, and the external device may be implemented by a source device which supports the second version.

As described above, according to various example embodiments, even though a user does not manually set a menu which changes EDID information corresponding to an HDMI version, VSDB data may be treated not to be lost regardless of a supportable version by just connecting an HDMI cable. Specifically, even if an HDMI 1.4 source device or an HDMI 2.0 source device is connected to an HDMI 2.0 sync device, VSDB data inside EDID data is properly detected so that an error which can be caused by a discrepancy between different HDMI versions may be prevented. That is, even though a user does not manually change an EDID setting corresponding to HDMI 2.0, if an HDMI 2.0 source device is connected, information of another area (e.g. the third area) having same contents as VSDB contents corresponding to HDMI 2.0 is read. Consequently, the same information as the information provided in the case in which a user manually changes a menu to an HDMI 2.0 EDID setting is read. Accordingly, an HDMI 2.0 source device may read a first area which is an EDID area for HDMI 1.4, and even if a sync device whose manual setting is set not to read a second area is connected, an optimal UHD screen or HDR screen may be provided.

Further, a guide for appropriately setting an HDMI UHD Color menu that a user finds unfamiliar in accordance with a context of the electronic device may be provided. In addition, based on a context of the electronic device, an HDMI UHD Color menu is automatically activated so that a user does not need to set an HDMI UHD Color menu manually.

Meanwhile, the methods described in the various example embodiments may also be implemented through simply a software/hardware upgrade of the conventional electronic device.

Moreover, a non-transitory computer readable medium in which a program that sequentially performs the control method may be provided according to an example embodiment.

A non-transitory computer readable medium is a medium that semi-permanently stores data, and can perform a reading through a device. Specifically, the various applications and programs described above may be stored in and provided through a non-temporary reading device such as a CD, a DVD, a hard disk, Blu-Ray, a disk, an USB, a memory card, ROM and the like.

The foregoing example embodiments and advantages are merely examples and are not to be construed as limiting the present disclosure. The present teaching can be readily applied to other types of apparatuses. Also, the description of the example embodiments is intended to be illustrative, and not to limit the scope of the claims, and many alternatives, modifications, and variations will be apparent to those skilled in the art.

What is claimed is:

1. An electronic device configured to receive content from an external device, the electronic device comprising:

a memory configured to store first resolution-related information for a first version of High-Definition Multimedia Interface (HDMI);

second resolution-related information for a second version of HDMI, the second HDMI version being an upgraded version of the first HDMI version; and third resolution-related information for the second version of HDMI, wherein the first resolution-related information is stored in a first Vendor-Specific Data Block (VSDB) of the memory, the second resolution-related information is stored in a second VSDB of the memory, and the third information is stored in an area of the memory other than the first VSDB and the second VSDB;

an HDMI port configured for communication with the external device; and a processor configured to:

determine whether a setting relating to communication with the external device via the HDMI port is a first setting or a second setting different from the first setting;

based on the setting relating to communication with the external device via the HDMI port being the first setting, control reading of the first VSDB and the third resolution-related information by the external device;

based on the setting relating to communication with the external device via the HDMI port being the second setting, control reading of the first VSDB, the second VSDB and the third resolution-related information by the external device; and receiving, through the HDMI port, content from the external device.

2. The electronic device of claim 1, wherein the setting relating to communication with the external device via the HDMI port comprises a menu setting.

3. The electronic device of claim 2, wherein the processor is configured to, based on the setting relating to communication with the external device via the HDMI port being the first setting and an input of content of the second HDMI version being received from the external device, automatically activate the menu or provide a UI for enabling activating of the menu.

4. The electronic device of claim 2, wherein the processor is configured to, based on Source Product Description (SPD) information with a predetermined bit being activated being received from the external device, automatically activate the menu or provide a UI for enabling activating of the menu.

5. The electronic device of claim 1, wherein the third resolution-related information comprises at least one bit of the area of the memory, and at least one other bit of the area of the memory comprises color information for color supportable in addition to color supportable in the first HDMI version.

6. An electronic device providing content, the electronic device comprising:

a High-Definition Multimedia Interface (HDMI) port configured for communication with an external device, the external device storing first resolution-related information for a first version of HDMI; second resolution-related information for a second version of HDMI, the second HDMI version being an upgraded version of the first HDMI version; and third information; and a processor configured to:

obtain identification information of the external device;

identify that the third information comprises resolution-related information for the second HDMI version based on the identification information;

in response to the first resolution-related information and the third information being obtained from the external device, providing the content to the external device based on the third information;

in response to the first resolution-related information, the second resolution-related information and the third information being obtained from the external device, providing the content to the external device based on at least one of the second resolution-related information and the third information, wherein the first resolution-related information is obtained from a first Vendor-Specific Data Block (VSDB) of a memory included in the external device, the second resolution-related information is obtained from a second VSDB of the memory, and the third information is obtained from an area of the memory other than the first VSDB and the second VSDB.

7. The electronic device of claim 6, wherein the processor is configured to control obtaining the third information from the area of the memory of the external device assigned to an ID Serial Number according to HDMI standard.

8. A method of controlling an electronic device which communicates with an external device through a High-Definition Multimedia Interface (HDMI) port, the external device stores, in a memory, first resolution-related information for a first version of HDMI; second resolution-related information for a second version of HDMI, the second HDMI version being an upgraded version of the first HDMI version; and third information, wherein the first resolution-related information is stored in a first Vendor-Specific Data Block (VSDB) of the memory, the second resolution-related information is stored in a second VSDB of the memory, and the third information is stored in an area of the memory other than the first VSDB and the second VSDB, the method comprising:

obtaining identification information of the external device;

identifying that the third information comprises resolution-related information for the second HDMI version based on the identification information;

in response to the first resolution-related information and the third information being obtained from the external device, providing content to the external device based on the third information; and in response to the first resolution-related information, the second resolution-related information and the third information being obtained from the external device, providing the content to the external device based on at least one of the second resolution-related information and the third information, wherein the first resolution-related information is obtained from the first Vendor-Specific Data Block (VSDB) of the memory, the second resolution-related information is obtained from the second VSDB of the memory, and the third information is obtained from the area of the memory other than the first VSDB and the second VSDB.

9. The method of claim 8, further comprising:

automatically enabling activating, based on the first resolution-related information and the third information being obtained from the external device, a menu of the external device related to the HDMI port or transmitting a control signal to the external device to provide a UI for enabling activating of the menu.

* * * * *